United States Patent [19]

Cameron

[11] 4,372,202

[45] Feb. 8, 1983

[54] EMERGENCY BRAKE FOR PRESSES

[75] Inventor: Russell J. Cameron, Rochester, Mich.

[73] Assignee: Ross Operating Valve Company, Detroit, Mich.

[21] Appl. No.: 208,546

[22] Filed: Nov. 20, 1980

[51] Int. Cl.[3] ..... B30B 15/10

[52] U.S. Cl. ..... 100/53; 83/DIG. 1; 188/82.9; 192/129 R

[58] Field of Search ..... 100/53, 289; 425/DIG. 45, 151, 153; 188/82.9, 187; 192/129 R, 138; 83/DIG. 1, 523, 526; 72/441, 446, 450

[56] References Cited

U.S. PATENT DOCUMENTS

| | | | |
|---|---|---|---|
| 1,741,439 | 12/1929 | Seybold | 192/138 |
| 2,240,630 | 5/1941 | Stacy | 100/53 |
| 2,306,949 | 12/1942 | Ipsen | 192/129 R |
| 3,147,836 | 9/1964 | Atkinson | 192/129 R |
| 4,190,143 | 2/1980 | Orita | 100/53 |

FOREIGN PATENT DOCUMENTS

| | | | |
|---|---|---|---|
| 987663 | 3/1965 | United Kingdom | 100/289 |

*Primary Examiner*—Billy J. Wilhite

*Attorney, Agent, or Firm*—Harness, Dickey & Pierce

[57] ABSTRACT

A safety brake for use on presses that provides a positive stop which is positioned so that its braking surfaces will be engaged if the press overtravels its normal home position due to failure of the standard clutch and brake system of the press. The braking surfaces of the emergency brake are moved to a released position when the press is energized to begin a cycle of its operation. Once the released braking surfaces have passed by each other during the normal cycle of press operation, they are returned to their braking positions so as to preclude overtravel of the press past its home position to any substantial degree if the conventional brake of the press should fail.

6 Claims, 5 Drawing Figures

EMERGENCY BRAKE FOR PRESSES

BACKGROUND OF THE INVENTION

This invention relates to an emergency brake for presses or the like and more particularly to an improved press emergency brake.

As is well known, most mechanical presses employ a clutch and brake arrangement which permits the press ram to move through a cycle of operation from a home position through a striking or operative position and back to the home position. Normally, the brake and clutch mechanism is operated so that the brake is released when the drive clutch is engaged and the brake is re-engaged and the clutch disengaged when the ram returns back to its home position. In order to provide additional safety, it has been proposed to incorporate an emergency brake for the ram which has the purpose of preventing accidental movement of the ram in the event of failure of the conventional press clutch and braking mechanism. For the most part, these emergency brakes incorporate positive detent elements which are engaged with each other when the press ram is in its home position. The disadvantage of this type of locking mechanism is that it depends upon the detent element being accurately aligned at the time the emergency brake is actuated. If this accurate alignment is not insured, the emergency brake will be inoperative. Another disadvantage of this type of system is that it does not truly provide an independent emergency brake that is only operative to stop the ram movement in the event of malfunction.

It is, therefore, a principle object of this invention to provide an improved emergency brake for presses or the like.

It is another object of this invention to provide an emergency brake for presses that does not depend upon accurate location of the braking elements to become effective and further one in which the braking elements may be moved to their braking position and retained in that position during a substantial part of the press operation cycle so as to insure safety braking in the event of failure.

SUMMARY OF THE INVENTION

This invention is adapted to be embodied in an emergency brake for a press or the like which has a ram and a driving element operatively connected to the ram for operating the ram through a cycle of operation from a home position to a working position and back to a home position. The emergency brake comprises a first brake element that is fixed for rotation upon operation of the driving element and a second brake element that is fixed against rotation relative to the first brake element, the first brake element has a braking surface that extends outwardly from one of its surfaces and the second brake element has a braking surface that is complementary to the braking surface of the first brake element. Means are provided for actuating the second brake element from a released position wherein the braking surfaces will not interfere with each other upon relative rotation of the braking elements and a safety position wherein the braking surfaces will engage each other to prevent further rotation of the first braking element. The braking surfaces of the first and second brake elements are spaced from each other when the ram is in its home position and the second braking element is in its safety position. The distance between the braking surfaces in this position is relatively small so that any overtravel of the driving element from its home position will be arrested by contact of the braking surfaces of the first and second braking elements.

DETAILED DESCRIPTION OF THE PREFERRED EMBODIMENT

Figure 1:
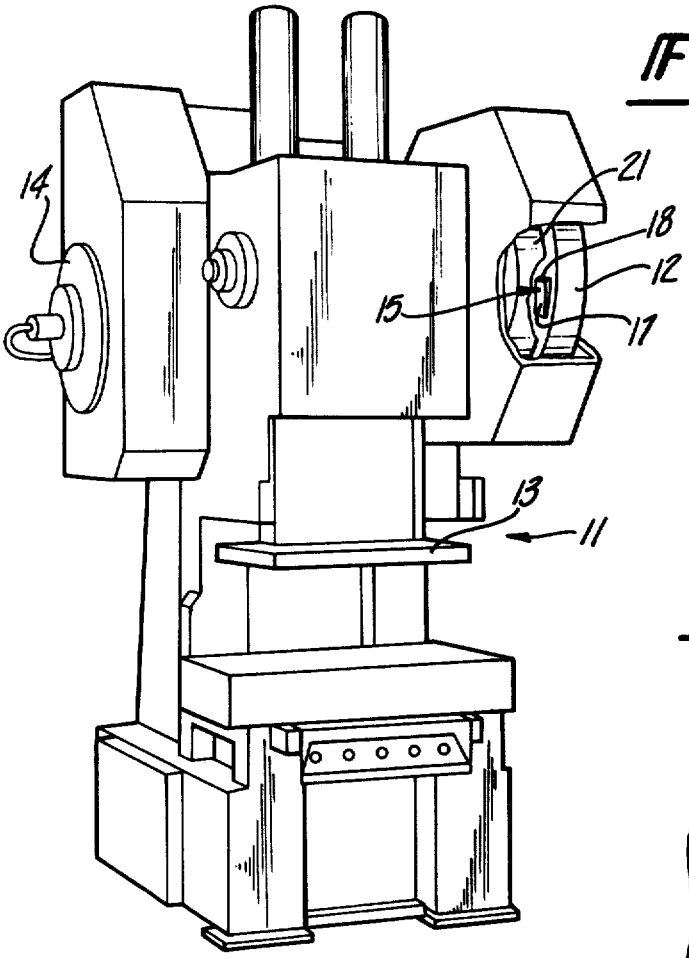
FIG. 1 is a perspective view, with a portion broken away, of a press embodying an emergency brake constructed in accordance with a embodiment of this invention.

Referring first to FIG. 1 of the drawings, a press embodying an emergency brake constructed in accordance with this invention is identified generally by the reference numeral 11. The press may be of any known type and is depicted as including a flywheel 12 which is driven in any known manner and which is specifically connected to the ram 13 for movement of the ram between its home position, as shown in FIG. 1, a striking or work position, and back to its home position. As is common with mechanical presses of the type shown, a clutch and brake mechanism is associated with the flywheel 12 and ram 13 for effecting operation of the ram 13 through a single cycle. As is well known, the clutch and brake mechanism is actuated to hold the flywheel 12 and ram 13 in its home position unitl a cycle of operation is commenced. During this inoperative period the brake is maintained engaged and the clutch disengaged. When the press is actuated the brake is released and the clutch is engaged so as to connect the flywheel 12 and ram 13 with the continuously driven motor of the press. This motor is not shown in detail but is indicated schematically at 14. As illustrated, the motor 14 with its clutch and brake are positioned on the side of the ram 13 opposite the flywheel 12. It is to be understood, however, that the motor, clutch and flywheel may all be positioned on the same side of the same or, alternatively, flywheels may be positioned on both side of the ram 13. The construction of the press per se forms no part of this invention and is merely described so as to illustrate the environment in which the invention is found.

After the ram 13 has completed its work cycle and is returning to its home position, the clutch is disengaged and the brake re-engaged. The construction and operation of the clutch and brake mechanism which are employed for this purpose are believed to be well known and form no part of this invention. Therefore, these elements have not been illustrated in any detail.

In accordance with this invention, an emergency brake is incorporated which is effective to provide a positive stop for rotation of the flywheel 12 and operation of the ram 13 past their home positions in any substantial distance. Thus, in the event the clutch and brake mechanism fails, an operator who places his hands beneath the ram 13 will not be injured.

Figure 2:
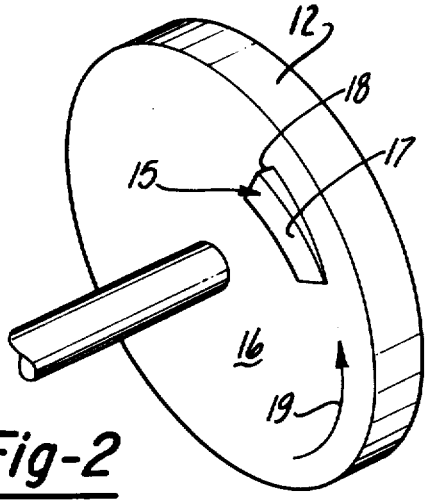
FIG. 2 is an enlarged perspective view showing the flywheel of the press in FIG. 1.
Figure 3:
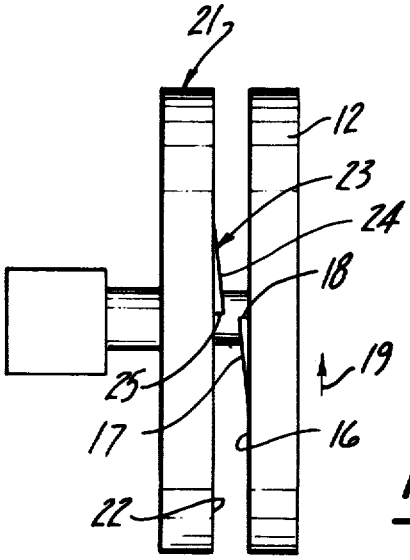
FIG. 3 is a side elevational view of the flywheel.

The emergency brake mechanism in the illustrated embodiment includes a ramp 15 which extends from one radially extending surface 16 of the flywheel 12 and extends axially therefrom. The ramp 15 includes a tapered or inclined portion 17 that terminates in an axially extending braking surface 18 which is generally radially disposed, as may be best seen from an inspection of FIG. 3. The normal direction of rotation of the flywheel 12 is indicated by the arrow 19 in FIGS. 2 and 4 wherein it may be seen that the incline surface 17 tapers outwardly from the flywheel surface 16 toward the braking surface 18 in the direction of rotation 19.

An axially moveable braking element, indicated generally by the reference numeral 21, is juxtaposed to the flywheel surface 16. The braking element 21 may be of a cylindrical shape and has a radially extending surface 22 which is complimentary to the flywheel surface 16. A braking ramp indicated generally by the reference numeral 23 extends axially outwardly from the surface 22 and includes an inclined portion 24 and an axially extending braking surface 25. The braking surface 25 is complimentary to the braking surface 18 of the flywheel ramp 15. The angle of inclination of the ramp surface 24 is the same as that of the surface 17 but in the opposite direction, as may be readily seen from an inspection of FIG. 4.

Figure 4:
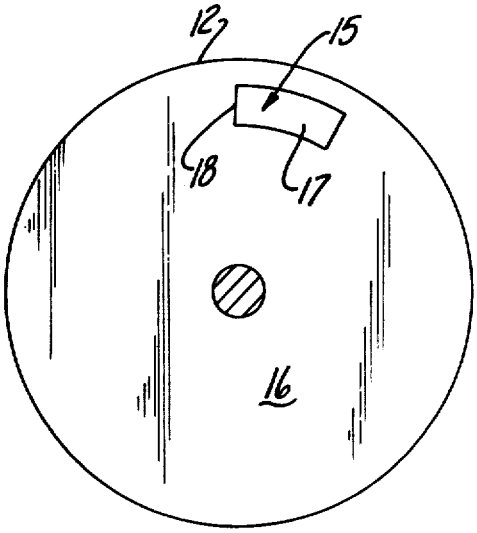
FIG. 4 is a top plan view of the flywheel and associated emergency brake mechanism.

The braking element 21 is actuated in any suitable manner from a released position as shown in FIG. 4 wherein the braking surfaces 18 and 25 are axially spaced from each other so that the flywheel 12 may rotate freely without encumbrance by the braking element 21 to an engaged or operative position. As has been previously noted, this movement is axial and may be accomplished by means of hydraulic or pneumatic motors and appropriately located springs, alternately, the axial movement may be effected electrically in any known manner. Because such actuating devices are believed to be well known to those skilled in this art, a detailed description of them is not believed to be necessary. However, the actuating and release device has been identified graphically by the box in FIG. 4.

When the braking element 21 is in its engaged or operative position, its surface 22 will be justaposed to the flywheel surface 16 with the spacing therebetween equal to the height of the braking surface 18 or 25 and the respective ramp braking surfaces 18 and 25 will be positioned in an interference location.

The braking surfaces 18 and 25 are located relative to the flywheel 12 and braking element 21 so that when the flywheel 12 is in its home position and the braking element 21, which is fixed against rotation, is in its operative or engaged position, the braking element braking surface 25 will be spaced slightly from the flywheel braking surface 18 in the direction of rotation of the flywheel 19. The amount of this spacing will depend upon the particular application involved, but should be something less than the order of 30° rotation of the flywheel 12 and before any substantial downward movement of the ram 13 from its home position will occur.

When the flywheel 12 is in its home position, the braking element 21 will have been positioned in its operative or braking position for a substantial period of time, as will become apparent. When a cycle of operation is initiated by the operator, the braking element 21 is actuated through appropriate electrical, hydraulic and/or pneumatic circuitry so that it will move to its disengaged position as shown in FIG. 4. The clutch and braking mechanism is then operated so that the flywheel 12 will commence rotation in the direction of the arrow 19 and the ram 12 may commence its downward movement.

As soon as the flywheel has rotated sufficiently so that the flywheel braking surface 18 has passed, in a radial direction, the braking element braking surface 25, the braking element 21 is actuated so as to again return it to its operative, braking, position. If this actuation is initiated before the ramp surfaces 17 and 24 are free of each other, which may be permitted and even desirable, the inclination of these surfaces will merely retard the movement of the braking element 21 to its appropriate braking position. The braking element 21 is then retained in this position until a new cycle of operation of the press 11 is initiated by the operator.

The flywheel 12 will continue to rotate to bring the ram 13 to its operative position and then back toward its home position. When the home position is reached or approached, the clutch and brake mechanism should be actuated so as to disengage the flywheel 12 from the driving motor 14 and so as to engage the brake to stop the flywheel 12 in its home position. In the event, however, of any malfunction of the clutch and brake mechanism, the braking element braking surface 25 will contact the flywheel braking surface 18 upon slight overtravel of the flywheel 12 and ram 13 from their home positions and prevent any injury to the operator who might have placed his hands back beneath the ram 13 under the assumption that the press was fully operative.

The circuitry and actuating device for controlling the movement of the brake element 21 has not been described or illustrated as aforenoted because it is believed it is well within the scope of the art to provide appropriate mechanism for achieving the aforedescribed operation. Furthermore, the emergency brake described may be used with other types of presses than the flywheel type by providing appropriate braking surfaces on elements which move in conjunction with movement of the ram of the press. An important feature of this invention is the positioning of the braking surfaces so that they are normally slightly spaced apart when the ram is in its home position even though the braking surfaces are disposed in their braking position. The braking surfaces are moved to their released position immediately upon actuation of the press and are returned to their braking position after the ram has undergone sufficient movement so as to move the braking surface past their contact point. In this way, it is unnecessary for the emergency brake to rely upon accurate positioning of the moving elements in a predetermined location so as to insure actuation of the emergency brake, as was true with prior art detent mechanisms which were held in their locked or braking position when the ram was in its home position.

Figure 5:
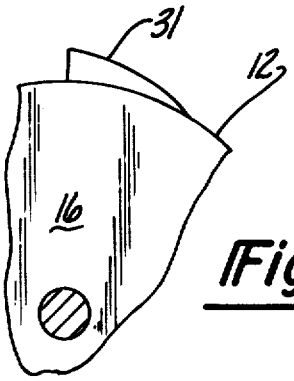
FIG. 5 is a partial side elevational view, in part similar to FIG. 3, showing another embodiment of the invention.

In the illustrated embodiment, one braking element 21 has been provided and the braking surfaces 18 and 25 extended axially from radially extending surfaces of the respective brake components. Of course, an additional braking element could be provided for co-action with a braking surface formed on the surface of the flywheel 12 opposite to the surface 16. Such braking elements would be actuated axially in unison so that they would in effect move toward and away from the flywheel 12 together. Alternately, the braking surfaces could extend radially outwardly beyond the outer periphery of the flywheel 12. The configuration of such an embodiment is shown in FIG. 5 wherein such a braking device associated with the flywheel 12 is identified by the reference numeral 31. Of course, both axial and radial braking surfaces could be incorporated. Various other changes and modifications from the illustrated embodiment are possible without departing from the spirit and scope of the invention as defined by the appended claims.

I claim:

1. An emergency brake for a press or the like having a ram and driving element operatively connected to said ram for operating said ram through a cycle of operation from a home position to a working position and back to a home position, said emergency brake comprising a first brake element fixed for rotation upon operation of said driving element, said first brake element having a braking surface extending outwardly from a surface thereof, a second brake element fixed against rotation relative to said first brake element, said second brake element having a braking surface complimentary to the braking surface of said first brake element, and means for actuating said second brake element from a released position wherein said braking surfaces will not interfere with each other upon relative rotation of said brake elements upon the initiation of a cycle of the press or the like and a braking position wherein said braking surfaces may engage each other to prevent further rotation of said first brake element after a predetermined movement of said first brake element less than that required for it to reach when the driving element is in its working position, said braking surfaces of said first and second brake elements being spaced from each other when said ram is in its home position and said second brake element is in its braking position, the spacing of said surfaces when in such positions being such that said surfaces will engage upon movement of said ram in a small increment beyond its home position towards its working position.

2. An emergency brake as set forth in claim 1 wherein the means for actuating the second brake element is operative to move said second brake element to its released position upon initiation of a cycle of operation of the ram and to its engaged position upon movement of said ram toward its working position from its home position in a predetermined amount.

3. An emergency brake as set forth in claim 2 further including cam surfaces formed on each of the first and second brake elements and extending from the respective braking surfaces of the first and second brake elements.

4. An emergency brake as set forth in claim 3 wherein the cam surfaces are oriented so that they will retard the movement of the second brake element to its braking position until the braking surfaces have moved passed each other more than a predetermined degree during the movement of the ram from its home position toward its working position.

5. An emergency brake as set forth in claim 1 wherein the braking surfaces extend axially from radially extending surfaces of the brake elements.

6. An emergency brake as set forth in claim 1 wherein the first brake element has a generally disc shape and its braking surface extends radially outwardly from the outer surface thereof.

* * * * *